US005191738A

United States Patent [19]

Nakazato et al.

[11] Patent Number: 5,191,738

[45] Date of Patent: Mar. 9, 1993

[54] METHOD OF POLISHING SEMICONDUCTOR WAFER

[75] Inventors: Yasuaki Nakazato, Koushoku; Hiroo Ogawara, Nagano, both of Japan

[73] Assignee: Shin-Etsu Handotai Co., Ltd., Tokyo, Japan

[21] Appl. No.: 781,644

[22] Filed: Oct. 25, 1991

Related U.S. Application Data

[63] Continuation of Ser. No. 539,180, Jun. 18, 1990, abandoned.

[30] Foreign Application Priority Data

Jun. 16, 1989 [JP] Japan ..... 1-153748

[51] Int. Cl.[5] ..... B24B 37/04

[52] U.S. Cl. ..... 51/283 R; 51/131.3; 51/131.4; 51/237 R

[58] Field of Search ..... 51/131.3, 131.4, 236, 51/237 R, 277, 283 R, 326

[56] References Cited

U.S. PATENT DOCUMENTS

| | | | |
|---|---|---|---|
| 2,979,868 | 4/1961 | Emeis . | |
| 3,559,346 | 2/1971 | Paola . | |
| 4,104,099 | 8/1978 | Scherrer | 51/277 |
| 4,165,584 | 8/1979 | Scherrer . | |
| 4,910,155 | 3/1990 | Cote et al. | 51/90 |

FOREIGN PATENT DOCUMENTS

| | | | |
|---|---|---|---|
| 2521895 | 8/1983 | France . | |
| 55-157472 | 12/1980 | Japan | 51/131.3 |
| 1-51268 | 2/1989 | Japan . | |
| 1-71663 | 3/1989 | Japan . | |
| 1-246070 | 10/1989 | Japan | 51/131.3 |
| 1151436A | 4/1985 | U.S.S.R. . | |

*Primary Examiner*—Bruce M. Kisliuk
*Assistant Examiner*—John A. Marlott
*Attorney, Agent, or Firm*—Oliff & Berridge

[57] ABSTRACT

A method of polishing a semiconductor wafer, wherein the semiconductor wafer bonded to a plate is polished to a desired thickness by pressing the semiconductor wafer against a rotating turntable side, and at the same time, a thickness regulating member, whose surface layer is made of a material slower to polish than the semiconductor wafer, is arranged on the plane of the plate to control the thickness of the semiconductor wafer. The matrix of the thickness regulating member is made of silicon and the surface layer facing said turntable is a silicon oxide film.

14 Claims, 3 Drawing Sheets

METHOD OF POLISHING SEMICONDUCTOR WAFER

This is a continuation of application Ser. No. 07/539,180 filed Jun. 18, 1990, now abandoned.

BACKGROUND OF THE INVENTION

1. Field of the Invention

The present invention relates to a method of polishing semiconductor wafers more particular to an effective technique suitable for polishing semiconductor wafers, whose surfaces to be polished are required to be very flat.

2. Description of the Related Art

The final step of manufacturing semiconductor silicon wafers includes a polishing step for forming a specular surface. This step generally employs a method called the mechanochemical method, which combines mechanical attrition and chemical reaction.

FIG. 4 shows the main components of a polishing apparatus for polishing one face of a semiconductor wafer. As shown in FIGS. 4 and 5, numeral 1 indicates a glass plate. A plurality of semiconductor wafers 2 are bonded with wax to the under surface of the glass plate 1. These semiconductor wafers 2, having undergone processes such as lapping, beveling and etching, are bonded in such a manner that they can be attached or removed. A polishing cloth 3*a* is firmly held on the surface of a turntable 3, which is positioned under the glass plate 1. Polishing is performed by using the apparatus in the following way. The semiconductor wafer 2 contacts the polishing cloth 3*a* under the pressure of the glass plate 1. At the same time, the turntable 3 rotates to cause the glass plate 1, supporting the semiconductor wafer 2, to rotate so as to bring the semiconductor wafer 2 into contact with the polishing cloth 3*a* on which polishing slurry is sprayed. As a result, the main surface of the semiconductor wafer 2 bonded to the underface of the glass plate 1 is polished. The polishing slurry is a weak alkaline aqueous solution containing colloidal silica as fine abrasive grains.

With an increasingly strong demand in recent years for high precision flatness in the semiconductor wafer surface to be polished because of microscopically fine patterns of semiconductor ICs, the following problems have arisen with the above-described polishing method.

When the semiconductor wafer is polished by the above-mentioned polishing apparatus, quality changes of the polishing cloth 3 occurs over time. In addition, deformation of the glass plate 1 caused by pressure applied when the semiconductor wafer 2 comes in contact with the polishing cloth 3*a* occurs, and different rotation speeds of the turntable 3 at various positions along the radius of the table 3 also take place. Uneven thickness of the polished semiconductor wafer caused by the above cited phenomena cannot be neglected from a view point of requirements for semiconductor IC devices's sophistication in recent years.

The uneven thickness gives much more influence on semiconductor on insulator (SOI)-structured devices having an extremely thin active zone.

The more the semiconductor wafer 2 is pressed against the polishing cloth 3*a*, the faster the polishing speed becomes. It is difficult, however, to control the polishing amount with a fast polishing speed. On the contrary, it is easy to control the polishing amount with a slow polishing speed, though polishing is time-consuming.

SUMMARY OF THE INVENTION

It is an object of the present invention to overcome the above-described problems in the conventional method, and to provide a method of quickly polishing a semiconductor wafer, which permits easy control of the polishing amount, and which further permits keeping unevenness in thickness of the semiconductor wafer where one surface is the surface to be polished to a minimum.

In order to achieve the aforesaid object, the present invention discloses a method of polishing a semiconductor wafer, wherein when the semiconductor wafer bonded to a plate is polished to a desired thickness by pressing the semiconductor wafer against a rotating turntable side, the semiconductor wafer is bonded to the plate, and at the same time, a thickness regulating member, at least whose surface layer is made of a material where polishing speed is slower than the semiconductor wafer, is arranged on the plane of the plate in order to control the thickness of the semiconductor wafer.

According to the present invention, a semiconductor wafer to be polished is bonded to a plate, and at the same time, the thickness regulating member, made of a material where polishing speed is slower than the semiconductor wafer, is arranged around the bonded semiconductor wafer and closely spaced-apart from it on the plane of the plate. The semiconductor wafer is polished by using the thickness regulating member, as a stopper. For these reasons, even if the polishing speed increases under circumstances that the semiconductor wafer is pressed to the turntable at increased pressure, a part of the pressure is to be borne by the thickness regulating member when the polishing is just about finished. As a result, the polishing speed becomes slow according to the increase in the pressure applied to the wafer by the amount of the pressure borne as mentioned above, and thus it is easy to control the polishing amount of the semiconductor wafer as well as the thickness of the semiconductor wafer. The polished surface of the semiconductor wafer thus becomes even in thickness variation across and specular.

Further, since the thickness regulating member, arranged around the semiconductor wafer, acts as a stopper, the semiconductor wafer is so polished that the surface of the thickness regulating member on the turntable side is substantially flush with the semiconductor wafer, thereby contributing to a less uneven thickness across the whole surface of the semiconductor wafer where one surface is the surface to be polished.

For all the reasons described above, a highly geometrically controlled polished semiconductor wafer can be obtained.

Other objects and novel features of the present invention will become apparent from the following Detailed Description of the Preferred Embodiment when read together with reference to the accompanying drawings.

DETAILED DESCRIPTION OF THE PREFERRED EMBODIMENTS

An embodiment of the method of polishing a semiconductor wafer according to the present invention will be described below.

Figure 1:
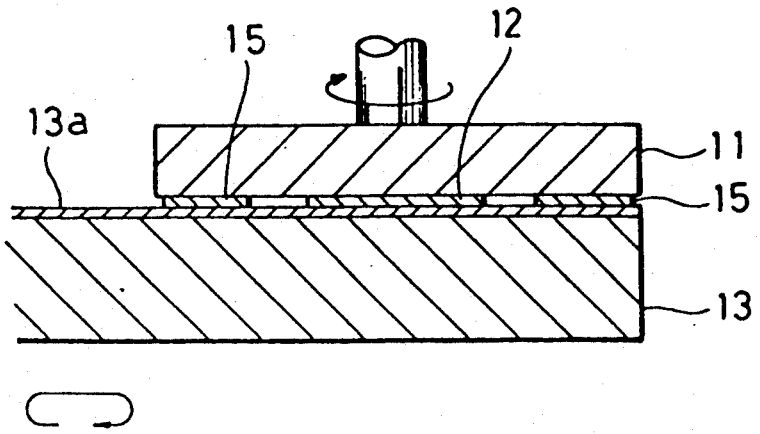
FIG. 1 is a vertical section showing part of a polishing apparatus utilized in the polishing method of an embodiment according to the present invention.

FIG. 1 shows the major components of a polishing apparatus for polishing one face of the semiconductor wafer.

Figure 2:
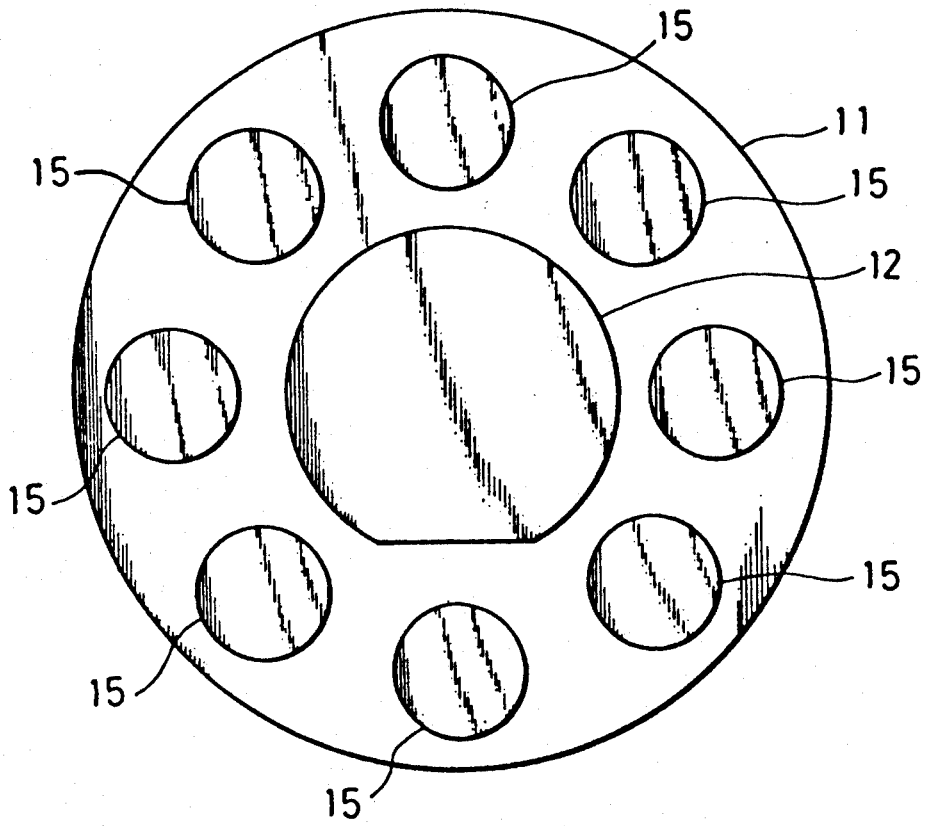
FIG. 2 is a plan view of a plate illustrating how a semiconductor wafer and dummy wafers (a thickness regulating member) are bonded to the plate.

As shown in FIGS. 1 and 2, one semiconductor wafer 12, having undergone processes such as lapping, beveling and etching, is bonded with wax to the central under surface of the glass plate 11. Moreover, a total of eight dummy wafers 15, serving as thickness regulating members, are so arranged on the under surface of the glass plate 11 as to encircle the above semiconductor wafer 12. When the semiconductor wafer 12 and the dummy wafers 15 are bonded with wax to the surface of the glass plate 11, it is desirable to control bonding gaps by the precision less than 0.1 μm, to meet the severest requirements ever demanded. Either of the following two methods allows such a control: the semiconductor wafer 12 is bonded to the surface of the glass plate 11 after molten wax is uniformly sprayed in very fine particles by a sprayer on the surface of the wafer 12 to be bonded; or the semiconductor wafer 12 and the dummy wafers 15 are heated after being just placed on the surface of the glass plate 11, and then the wax is introduced to the gaps under the wafers having been melted at a point of the periphery already warmed up before the semiconductor wafer 12 and the dummy wafers 15 are pressed and cooled to fix in order to decrease the gaps and thus clear the severest precision of less than 0.1 μm.

Either the entire matrix of the dummy wafers 15 or at least their surface layers are made of a material slower to polish than the semiconductor wafer 12. For example, the matrix of the dummy wafer 15 is made of silicon and a silicon oxide film is formed on the surface layer of the dummy wafer 15. The silicon oxide film may be a thermal oxide film or an oxide film obtained by chemical vapor deposition method (CVD) and is preferably a thermal oxide film, which is slower to remove in polishing by the mechanochemical polishing method. The dummy wafers 15 are bonded with wax to the glass plate 11 in the same manner as in the semiconductor wafer 12, that is, they can be attached or removed, or they are bonded semipermanently with epoxy resin or the like to the glass plate 11. If the dummy wafer 15 is made of a material quite extremely slower to polish than the semiconductor wafer 12, it is convenient to bond the dummy wafer 15 semipermanently to the glass plate 11. When the matrix of the dummy wafer 15 is made of silicon, it is possible to control the thickness of the semiconductor 12 very effectively and accurately.

A polishing cloth 13*a* is bonded to the upper surface of the turntable 13 under the glass plate 11.

Polishing is performed by using the polishing apparatus as follows: the semiconductor wafer 12 contacts the polishing cloth 13*a* under the pressure of the glass plate 11. At the same time, the turntable 13 rotates to cause the glass plate 11, supporting the semiconductor wafer 12, to rotate so as to bring the semiconductor wafer 12 into contact with the polishing cloth 13*a*. As a result, the main surface of the semiconductor wafer 12 bonded to the under surface of the glass plate 11 is polished. As an example of a polishing agent, during the polishing operation, colloidal silica, dispersed in an aqueous solution with a pH adjusted to weak alkalinity with NaOH or $NH_4OH$, is employed. When the semiconductor wafer 12 is polished by the above-described method, the effects described below can be obtained.

That is, according to the embodiment described above, the semiconductor wafer 12 to be polished is bonded to the central under surface of the glass plate 11, and at the same time, dummy wafers 15, made of a material slower to polish than the semiconductor wafer 12, are arranged around the semiconductor 12 under the glass plate 11. For instance, when the matrix of the dummy wafer 15 is made of silicon and a thermal oxide film is formed on its surface layer, the polishing speed for the dummy wafer 15 is, depending upon polishing conditions, 1/200 or less of the polishing speed of the silicon.

Because the semiconductor wafer 12 is polished by using the dummy wafers 15 as a stopper, even if polishing speed increases owing to the condition that the semiconductor wafer 12 is pressed to the turntable 11 under increased pressure, part of the pressure will be borne by the dummy wafers 15 through the whole polishing operation. As a result, the polishing speed slows according to an amount of the pressure shared with the dummy wafers, and thus it is easy to control the polishing amount of the semiconductor wafer 12 as well as the thickness across the whole surface of the semiconductor wafer 12. The polished surface of the semiconductor wafer 12 thus becomes even in thickness across and specular.

Further, since the dummy wafers 15, arranged around the semiconductor wafer 12, act as a stopper, the semiconductor wafer 12 is so polished that the surfaces of the dummy wafers 15 on the turntable side 11 are substantially flush with the semiconductor wafer 12, thereby contributing to a less uneven thickness of the semiconductor wafer 12 where one surface is the surface to be polished. For all the reasons described above, a highly geometrically controlled semiconductor wafer 12 can be obtained.

The following experiment was performed to confirm the reduced unevenness of thickness of the semiconductor wafer where one surface is the surface to be polished.

In the experiment, seventeen semiconductor wafers to polish having a diameter of 150 mm and, as thickness regulating members, dummy wafers, in a ratio of, for example, four dummy wafers per each semiconductor wafer whose matrix is of silicon and whose surface layer is formed with a silicon oxide film by thermal oxidation, were used.

Figure 3:
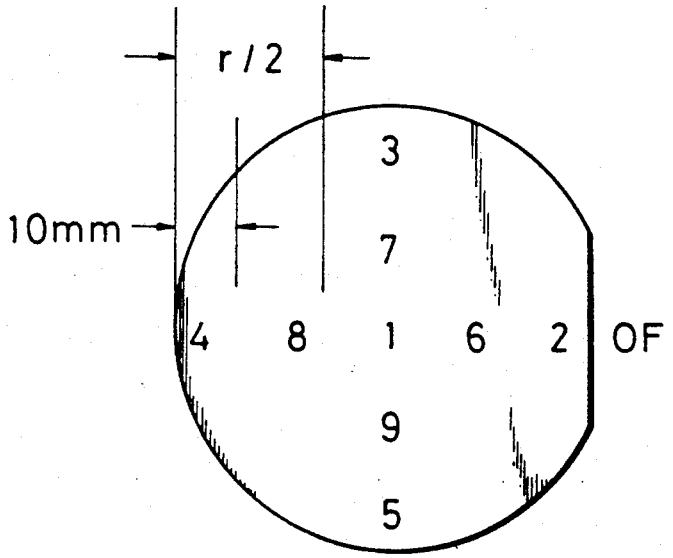
FIG. 3 is a plan view of the semiconductor showing positions to measure the thickness of the semiconductor wafer according to an experiment.
Figure 4:
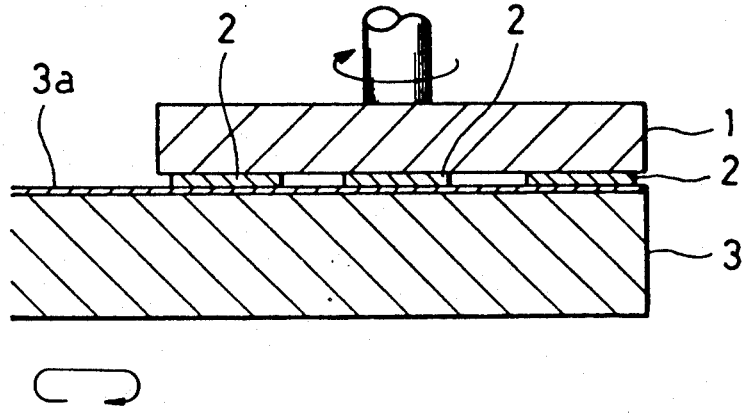
PRIOR ART FIG. 4
FIG. 4 is a vertical section showing part of a polishing apparatus used in a conventional method.
Figure 5:
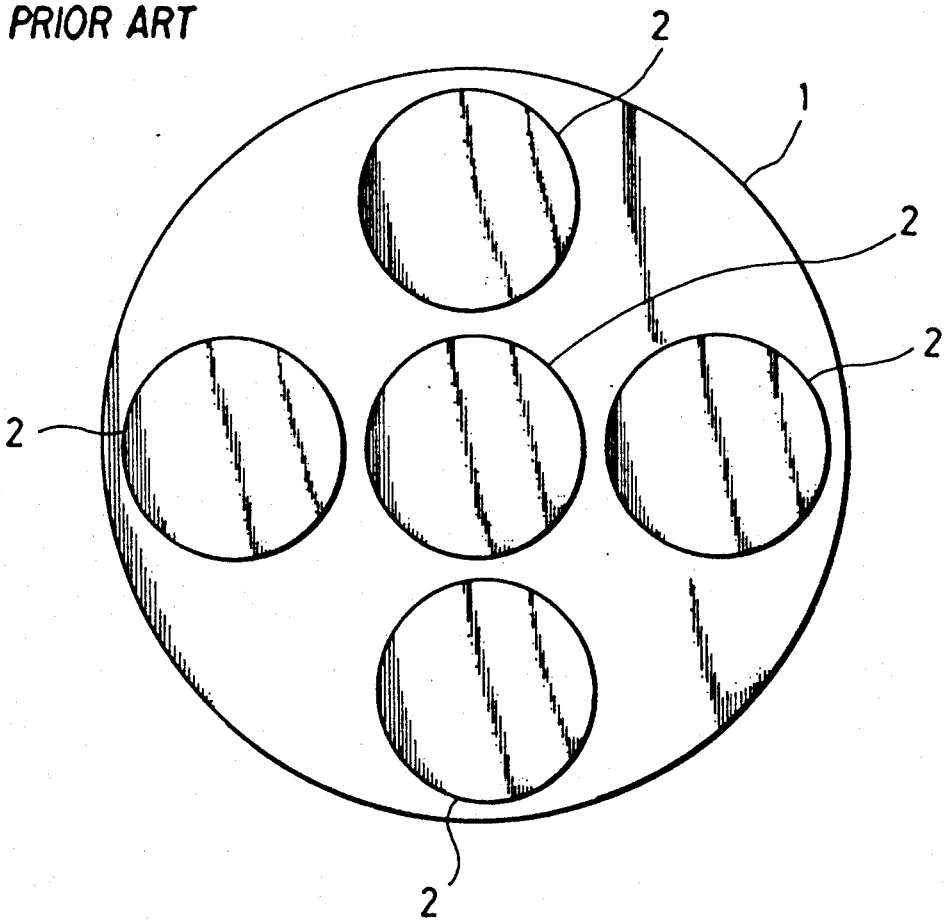
FIG. 5 PRIOR ART
FIG. 5 is a plan view of a plate illustrating how the semiconductor wafer is bonded to the plate.

As shown in FIG. 3, there are nine positions for measuring the thickness of the semiconductor wafer. We found that it was possible to control very precisely the thickness of the semiconductor wafer according to the experiment. For example, when polished down by about 20 μm on the average, the semiconductor wafers whose thickness at a center from the average deviates within ±0.3 μm, comprised 75.8% of the total; the semiconductor wafers whose thickness deviation was 0.1 μm or less comprised 50%. The invention has been described in detail with particular reference to the preferred embodiment thereof, but it will be understood that variations and modifications of the invention can be made within the spirit and scope of the invention.

For instance, although as the thickness regulating member, the dummy wafer 15, whose matrix is silicon and with a silicon oxide film formed on its surface layer, is used, a dummy wafer, whose matrix is silicon and with a silicon nitride film formed on its surface layer, can also be used. Furthermore, materials, such as quartz, plastic or sapphire can be used for the dummy wafer as the thickness regulating member. Metal can be used for dummy wafer if contamination is not a factor. The shape of the dummy wafer is not necessarily the same as that of the semiconductor wafer. A ring-shaped dummy wafer can be employed so as to encircle the semiconductor wafer 12. The important thing to be considered is to use a dummy wafer, which is capable of sharing part of the pressure used to polish the semiconductor wafer on the turntable and which is capable of serving as a stopper.

Typical effects obtained from the present invention will be briefly described below. When the semiconductor wafer is polished to its desired thickness by pressing it against the rotating turntable side, the semiconductor wafer is bonded to the plate, and at the same time, the thickness regulating member, at least whose surface layer is made of a material slower to polish than the semiconductor wafer, is arranged on the plane of the plate. The thickness regulating member controls the semiconductor wafer thickness. For these reasons, even if the polishing speed increases, it becomes easy to control the polishing amount of the semiconductor wafer. Moreover, because when the table axis vibrates or the like the pressure is borne by the thickness regulating member, the semiconductor wafer is not polished to a thinner thickness than the thickness of the thickness regulating member. As a result, the uneven thickness of a semiconductor wafer where one surface is the surface to be polished is reduced and thus a highly geometrically controlled semiconductor wafer can be obtained.

What is claimed is:

1. In a method of polishing a semiconductor wafer wherein said semiconductor wafer is bonded to the plane of a plate and polished to a desired thickness by pressing said semiconductor wafer against a side of a rotating turntable, the improvement wherein said semiconductor wafer is bonded to a central area of the plane of said plate and a thickness regulating member, at least a surface layer of which is made of a material slower to polish than said semiconductor wafer, is circumferentially arranged around said semiconductor wafer on the plane of said plate in order to control the thickness of said semiconductor wafer, said thickness regulating member has a matrix made of silicon and said surface layer which member has a matrix made of silicon and said surface layer which is formed on said matrix facing the side of said turnable is a silicon oxide film constituting the material, and said semiconductor wafer and said thickness regulating member are pressed against the side of the rotating turntable to polish said semiconductor wafer, said thickness regulating member bearing part of the pressure applied to said semiconductor wafer during the polishing process.

2. The method of claim 1, wherein said thickness regulating member comprises at least two dummy wafers arranged circumferentially about said semiconductor wafer.

3. In a method of polishing a semiconductor wafer according to claim 1, wherein said thickness regulating member comprises at least two dummy wafers spaced one from another to circumferentially surround said semiconductor wafer.

4. A method of polishing a semiconductor wafer according to claim 1, wherein said thickness regulating member comprises a plurality of dummy wafers spaced one from another to circumferentially surround said semiconductor wafer.

5. A method of polishing a semiconductor wafer comprising:

bonding a semiconductor wafer to a central area of the plane of a plate, wherein said plate has a thickness regulating member mounted circumferentially around said semiconductor wafer, said thickness regulating member having a surface layer made of a material which effects a lower polishing rate relative to the polishing rate of said semiconductor wafer and acts to control the thickness of said semiconductor wafer, said thickness regulating member has a matrix made of silicon and said surface layer which is formed on said matrix is a silicon oxide film constituting the material; and pressing said semiconductor wafer and said thickness regulating member against the side of a rotating turntable to polish said semiconductor wafer, said thickness regulating member bearing part of the pressure applied to said semiconductor wafer during the polishing process.

6. The method of polishing a semiconductor wafer according to claim 5, wherein said thickness regulating member comprises at least two dummy wafers arranged circumferentially about said semiconductor wafer.

7. The method of polishing a semiconductor wafer according to claim 5, wherein said surface layer which is formed on said matrix is made of a silicon nitride film rather than the silicon oxide film.

8. The method of polishing a semiconductor wafer according to claim 5, wherein said thickness regulating member comprises a plurality of dummy wafers arranged circumferentially about said semiconductor wafer.

9. In a method of polishing a semiconductor wafer wherein said semiconductor wafer is bonded to the plane of a plate and polished to a desired thickness by pressing said semiconductor wafer against a side of a rotating turntable, the improvement wherein said semiconductor wafer is bonded to a central area of the plane of said plate and a thickness regulating member, at least a surface layer of which is made of a material slower to polish than said semiconductor wafer, is circumferentially arranged around said semiconductor wafer on the plane of said plate in order to control the thickness of said semiconductor wafer, wherein said thickness regulating member has a matrix made of silicon and said surface layer which is formed on said matrix facing the side of said turnable is a silicon nitride film constituting the material, and said semiconductor wafer and said thickness regulating member are pressed against the side of the rotating turntable to polish said semiconductor wafer, said thickness regulating member bearing part of the pressure applied to said semiconductor wafer during the polishing process.

10. The method of polishing a semiconductor wafer according to claim 9, wherein said thickness regulating member comprises at least two dummy wafers arranged circumferentially about said semiconductor wafer.

11. The method of polishing a semiconductor wafer according to claim 9, wherein said thickness regulating member comprises a plurality of dummy wafers arranged circumferentially about said semiconductor wafer.

12. In a method of polishing a semiconductor wafer wherein said semiconductor wafer is bonded to the plane of a plate and polished to a desired thickness by pressing said semiconductor wafer against a side of a rotating turntable, the improvement wherein said semiconductor wafer is bonded to a central area of the plane of said plate and a thickness regulating member, at least a surface layer of which is made of a material slower to polish than said semiconductor wafer, is circumferentially arranged around said semiconductor wafer on the plane of said plate in order to control the thickness of said semiconductor wafer, wherein said thickness regulating member is made of a material selected from the group consisting of quartz, plastic, sapphire and metal and said semiconductor wafer and said thickness regulating member are pressed against the side of the rotating turntable to polish said semiconductor wafer, said thickness regulating member bearing part of the pressure applied to said semiconductor wafer during the polishing process.

13. A method of polishing a semiconductor wafer according to claim 12, wherein said thickness regulating member comprises a plurality of dummy wafers spaced one from another to circumferentially surround said semiconductor wafer.

14. A method of polishing a semiconductor wafer according to claim 12, wherein said thickness regulating member comprises at least two dummy wafers spaced one from another to circumferentially surround said semiconductor wafer.

* * * * *